US005154225A

United States Patent [19]

Armbruster et al.

[11] Patent Number: 5,154,225

[45] Date of Patent: Oct. 13, 1992

[54] OIL COOLER FOR AN INTERNAL-COMBUSTION ENGINE

[75] Inventors: Horst Armbruster, Illingen; Hans Martin, Stuttgart, both of Fed. Rep. of Germany

[73] Assignee: Behr GmbH & Co., Fed. Rep. of Germany

[21] Appl. No.: 613,015

[22] Filed: Nov. 15, 1990

[30] Foreign Application Priority Data

Nov. 17, 1989 [DE] Fed. Rep. of Germany ..... 3938253

[51] Int. Cl.[5] ..... F28D 1/02; F28F 13/12; F28F 3/10

[52] U.S. Cl. ..... 165/51; 165/167; 165/916

[58] Field of Search ..... 165/166, 167, 916, 51

[56] References Cited

U.S. PATENT DOCUMENTS

| | | | |
|---|---|---|---|
| 2,222,721 | 11/1940 | Ramsaur | 165/166 |
| 2,511,084 | 6/1950 | Shaw | 165/166 |
| 4,501,321 | 2/1985 | Real et al. | 165/166 |
| 4,580,625 | 4/1986 | Yamanaka et al. | 165/167 |
| 4,669,532 | 6/1987 | Tejima et al. | 165/167 |
| 4,708,199 | 11/1987 | Yogo et al. | 165/167 |
| 4,742,866 | 5/1988 | Yamanaka et al. | 165/167 |
| 4,892,136 | 1/1990 | Ichihara et al. | 165/167 |
| 4,967,835 | 11/1990 | Lefeber | 165/167 |

FOREIGN PATENT DOCUMENTS

| | | | |
|---|---|---|---|
| 0124217 | 11/1984 | European Pat. Off. | 165/916 |
| 2306426 | 8/1974 | Fed. Rep. of Germany | 165/916 |
| 2843423 | 12/1979 | Fed. Rep. of Germany . | |
| 0580039 | 10/1924 | France | 165/166 |
| 2319869 | 2/1977 | France . | |
| 0083883 | 4/1986 | Japan | 165/166 |
| 0073089 | 4/1987 | Japan | 165/916 |
| 0488571 | 7/1938 | United Kingdom | 165/166 |
| WO 8804761 | 6/1988 | World Int. Prop. O. . | |

*Primary Examiner*—John K. Ford

*Attorney, Agent, or Firm*—Evenson, Wands, Edwards, Lenahan & McKeown

[57] ABSTRACT

Soldered disk oil coolers are made using two disk plate which are stacked on one another for forming a hollow body, and are connected by soldering their outer edges. The individual disk bodies are constructed of two plates of a circular or elliptic shape in such a manner that their edges overlap one another and are in this case adapted to one another such that the outer edge is lockingly and under tension held at the inner edge of the other plate.

15 Claims, 4 Drawing Sheets

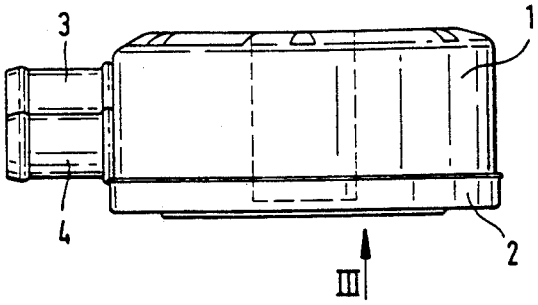
FIG. 2
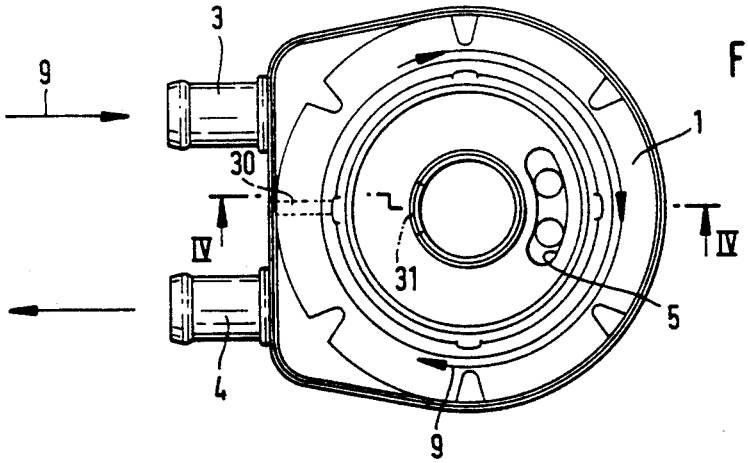
FIG. 1
FIG. 4
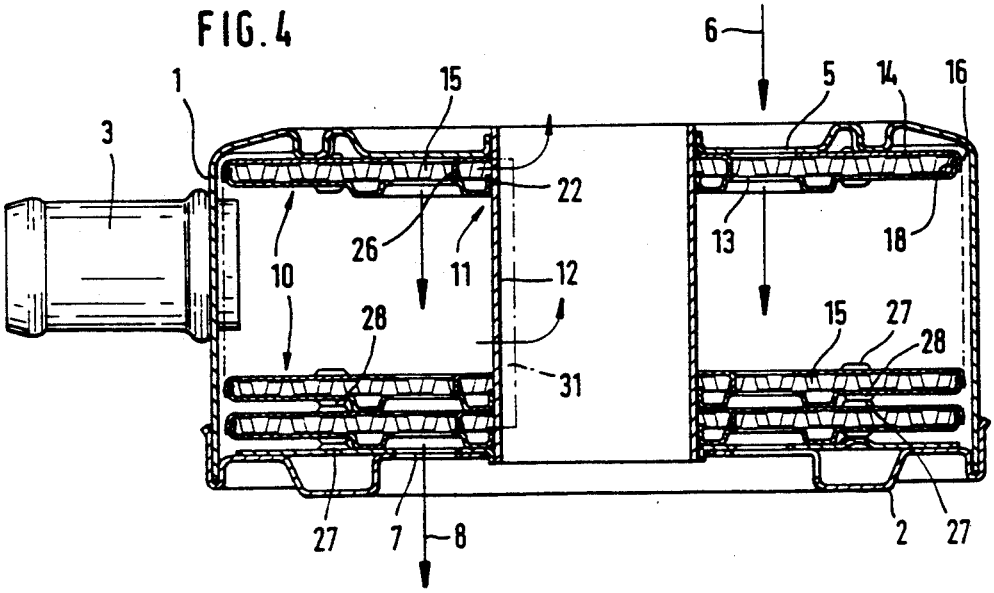

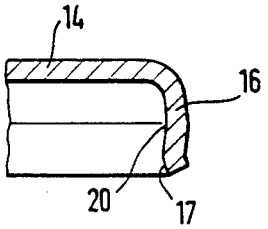
FIG. 7
FIG. 12
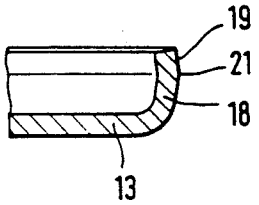
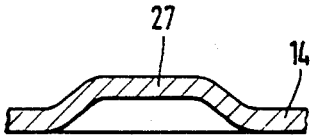
FIG. 8
FIG. 13
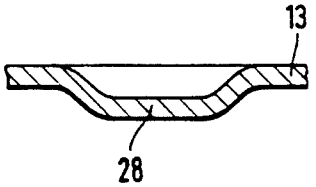
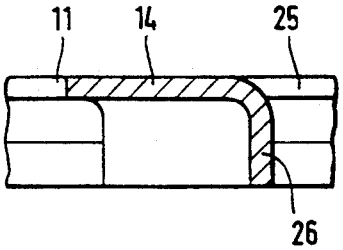
FIG. 9
FIG. 14
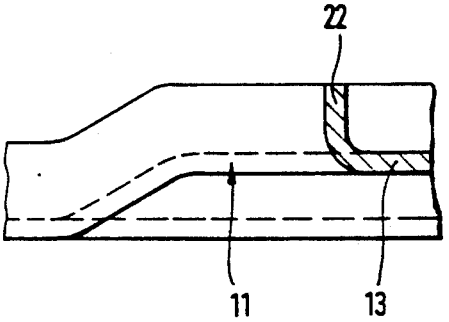

OIL COOLER FOR AN INTERNAL-COMBUSTION ENGINE

BACKGROUND AND SUMMARY OF THE INVENTION

The invention relates to comprising several disk bodies which are arranged in a stacked manner in a housing through which a cooling liquid flows. The bottom part of the disk bodies is formed by one of two spaced profiled plates which fit together, and the lid of the disk bodies is formed by the second plate, the edges of the spaced profiled plates being soldered together and enclosing a hollow space through which the oil flows that is to be cooled and which is connected with the hollow spaces of adjacent disk bodies by way of flow-through openings.

Disk oil coolers are known (German Patent Document DE-AS 28 43 423). During the manufacturing of the known disk oil coolers, the plates which form the outer walls of the chambers through which the oil flows are pushed onto a central tube and, by means of outwardly projecting collars arranged in the area of the tube and by means of inwardly directed molded-out edges arranged in the area of their outer circumference, are placed loosely against one another. Turbulence inserts are also inserted between the plates which form one oil chamber respectively. The plates which were stacked in this manner will then be soldered together. In this case, it must be ensured that the respective inner and outer edges of the plates are in sufficiently firm contact with the assigned parts of adjacent plates because otherwise no reliable soldering can be achieved. This requires relatively high expenditures.

An oil cooler of the initially mentioned type is also known (WO 88/04761). There flat tubular bodies are provided for oil coolers which are constructed of two oblong plate halves respectively. These plate halves are provided with surrounding edges which overlap one another and are soldered together. In this case, it is difficult to hold the longitudinal edges of the plate halves, which extend in parallel to one another, against one another in all areas so firmly for the soldering operation that the desired soldering gap or seam is obtained at every point.

It is an object of the present invention to simplify a disk oil cooler of the initially mentioned type with respect to the manufacturing.

For achieving this object, it is provided according to preferred embodiments of the invention that the edges are adapted to one another such that the outer edge is held at the inner edge in a catching manner and under tension. As a result of this measure, the individual disk bodies, even before the soldering operation, can easily be firmly joined together in the manner of a can and, in each case, without the aid of any mounting devices, can also hold the turbulence inserts assigned to them. When the thus formed disk bodies are then pushed onto the tube, there is also no risk of tilting because the two plates which belong to one another are already centered with respect to one another. During the subsequent soldering process, the advantage is also achieved that the edges which are held in one another in a locking manner and under tension form the desired narrow soldering gap surroundingly on the whole circumference and thus ensure a tight soldering-together. It is also an advantage that the soldering material, for example, in the form of soldering foils, can also be clipped in and held during the mechanical pre-assembly so that no additional operations are required for the manufacturing. In a simple manner, the plates may also be solder-plated so that the inserting of soldering foils will not be necessary.

Advantageous further developments of the object of the invention include provision that the required bracing is uniformly maintained over the whole circumference and is not, as in the state of the art, made impossible by straight edges. In preferred embodiments, the disk bodies can advantageously be placed on one another and joined together in a simple manner by providing that the plates have a circular or elliptic shape. Advantageous embodiments include providing both plates with interior and exterior chamfering, also aiding in the joining together of the plates. In preferred embodiments, an arrangement is provided wherein the annular wall section of the disk plates are each provided with chamfering which mutually engages with chamfering of the other of the disk plate annular wall sections to lockingly hold the plates together. This has the advantage that the two plates forming the hollow space do not have to be mutually spaced by separate measures. After their outer edges engage under tension, they are arranged at the correct distance from one another. The distance to the adjacent disk bodies may be ensured by providing an arrangement wherein the annular wall section of the top disk plate has an internally surrounding indentation and the annular wall section of the bottom disk plate has an externally surrounding edge which lockingly fits the internally surrounding indentation of the annular wall section of the top plate. Preferred embodiments include arrangements wherein the bottom disk plate is provided with an inwardly directed passage which can be pushed onto a central oil cooler tube, thus ensuring the simple positioning of the disk body on the central mounting tube in which case, at the same time, the mutual distance of the plates is also maintained at the inside diameter. Preferred embodiments include arrangements wherein the top disk plate has a central opening corresponding to the inwardly directed passage of the bottom disk plate, said opening being adapted to be pushed onto the tube, thus ensuring that the flow takes place through the hollow spaces, the type of the flow depending on the selected shape of the housing.

Other objects, advantages and novel features of the present invention will become apparent from the following detailed description of the invention when considered in conjunction with the accompanying drawings.

BRIEF DESCRIPTION OF THE DRAWINGS

FIG. 1 is a top view of a disk oil cooler constructed according to a preferred embodiment of the invention;

FIG. 2 is a lateral view of the disk oil cooler of FIG. 1;

FIG. 4 is an enlarged representation of the sectional view along Line IV—IV of the disk oil cooler of FIG. 1, with a variant also outlined in FIG. 1;

FIG. 7 is an enlarged representation of a detail of area VII in FIG. 5;

FIG. 8 is an enlarged representation of a detail of the sectional view along Line VIII—VIII of FIG. 5;

FIG. 9 is en enlarged representation of the detail IX in FIG. 5;

FIG. 12 is an enlarged representation of a detail in the area XII of FIG. 10;

FIG. 13 is an enlarged partial representation of the sectional view XIII—XIII of FIG. 10; and FIG. 14 is an enlarged partial representation of the sectional view XIV of FIG. 10.

DETAILED DESCRIPTION OF THE DRAWINGS

Figure 3:
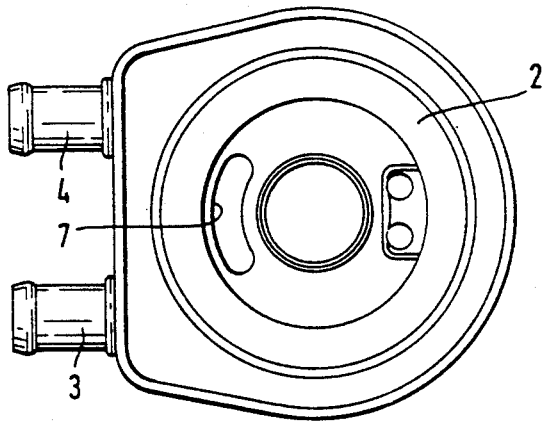
FIG. 3 is a view of the disk oil cooler of FIGS. 1 and 2 taken in the direction of the arrow III of FIG. 2.

FIGS. 1 to 3 illustrate a can-shaped housing 1 of a disk oil cooler which is constructed in the shape of a cup and is closed in the downward direction by a bottom 2 which is placed on it and which, on the outside, reaches over the free edge of the cup-shaped housing 1. The housing 1 is provided with a feeding piece 3 for the cooling liquid which, as a rule, is the cooling water of the engine to which the oil cooler is attached for the cooling of the engine oil. The housing 1 also has a discharge piece 4 for the cooling water. The feeding and discharge pieces 3, 4 are closed off with respect to one another by means of a partition extending on the waterside which—as will be explained in the following (FIGS. 10, 11)—is formed by a molding-out 30 at the disk bodies. As illustrated by FIG. 1, a feeding opening 5 for the oil to be cooled is provided at the top side of the cup-shaped housing 1, the oil, in a manner not shown in detail, being guided to the housing 1 in the direction of the arrow 6, then flowing through the disk bodies which will still be explained, and leaving the housing 1 through a discharge opening 7 at the bottom 2 in the direction of the arrow 8. The entering and exiting of the oil therefore takes place transversely to the flow of the cooling water which is indicated by means of the arrows 9 in FIG. 1.

FIG. 4 illustrates that the disk oil cooler is constructed of several disk bodies 10 on the inside of the housing 1, the disk bodies 10 being stacked on one another on the inside of the cup-shaped housing 1 and each, by means of a central opening 11 (see FIGS. 5, 6, 10 and 11) being pushed onto a tube 12 extending centrally in the housing 1, the longitudinal axis of the tube 12 extending in parallel to the exterior walls of the cup-shaped housing 1. As will be explained in the following, each disk body 10 comprises two plates 13, 14 which are each assigned to one another, the plate 14 shown in FIGS. 5 and 6 forming the lid, and the plate 13 shown in FIGS. 10 and 11 forming the bottom part of a disk body 10 which is constructed in the manner of a can and in its hollow space also accommodates a turbulence insert 15 which has the purpose of improving the heat transfer between the oil which in each case flows through the disk bodies 10 and the cooling water flowing around the disk bodies 10 on the outside. The plates 13, 14 both have a circular shape.

The embodiment of FIGS. 1 to 4 is intended for use in an oil cooler with an oil filter which, in a manner not shown in detail, connects to the side of the oil cooler of FIG. 4 which faces the outlet opening 7. The oil which is cleaned by the oil filter will then be returned to the engine through the opening of the sleeve 12.

For a construction in which no oil filter is used, as, for example, in the case of the transmission oil cooling, the space bordering on the outlet opening 7 can therefore be sealed off tightly inside the surrounding molded-out area of the housing and, as indicated by an interrupted line in FIGS. 1 and 4, a slot 31 is provided in the sleeve 12 which extends through longitudinally on one side and through which, in this case, the oil can flow from the individual disk bodies directly into the sleeve 12, when the outlet opening 7 is closed, and can then flow back again from there.

Figure 5:
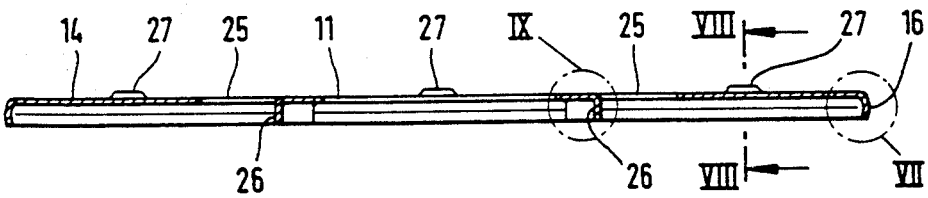
FIG. 5 is the representation of a sectional view similar to FIG. 4 of a lid plate used for the manufacturing of a disk body of the oil cooler of FIGS. 1 to 4.
Figure 10:
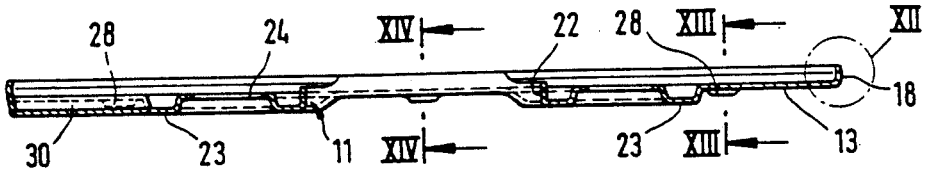
FIG. 10 is a sectional representation similar to FIG. 5 but of the second plate which is used for forming a disk body and is provided as the bottom part.
Figure 11:
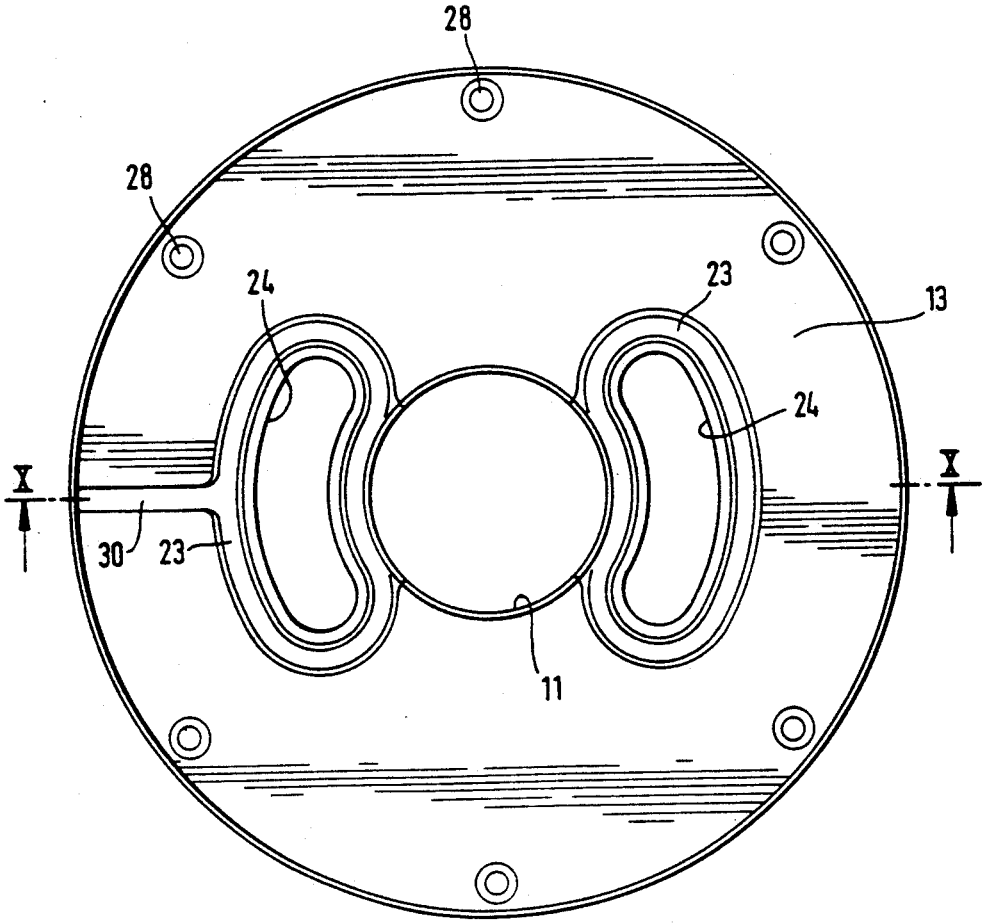
FIG. 11 is a top view of the plate of FIG. 10.

As illustrated in detail in FIGS. 5 and 10 as well as in FIGS. 7 and 12, the plate 14 forming the lid has an outwardly surrounding edge 16 which is directed toward the bottom part 13, the free end of which is bent slightly toward the outside, and thus forms an interior chamfering 17 which facilitates the pushing of the edge 16 over the edge 18 of the plate 13 (FIG. 12) forming the bottom part. For the same purpose, the free end of the edge 18 of the plate 13 is slightly directed toward the inside so that a chamfering 19 is created there which is disposed on the outside. The edge 16 of the plate 14 has its largest interior dimension approximately in its center of its height. Here, a surrounding indentation 20 is provided which has an obtuse-angled cross-section with a vertex directed toward the outside. Correspondingly, the edge 18 is constructed such that, on the outside, it has a shape which corresponds approximately to the obtuse-angled cross-section of the edge 16, the vertex of the obtuse angle also being directed toward the outside so that a surrounding edge 21 is created which, when the lid and the bottom part of a disk body 10 are pressed into one another, that is, when the plates 14, 13 are pressed into one another, snaps into the indentation 20 of the outer edge 16. In this case, the dimensions are selected such that the edges 16, 18 rest against the whole circumference under prestress. This type of a prestress may also be achieved in that the plates are design to be elliptic or egg-shaped. It cannot be achieved when the shape is oval with straight longitudinal sides because no defined elastic contact pressure force would be possible at the longitudinal sides which extend in parallel to one another.

In the area of the interior opening 11, a passage 22 is molded out in the plate 13 forming the bottom part of the disk body 10 which points to the interior hollow space of the disk body 10, frames the opening 11 and therefore, with its inside diameter, corresponds to the outside diameter of the tube 12. In addition, also in order to increase the stability, outwardly directed molded-out areas 23 are provided which frame kidney-shaped openings 24 on respective opposite sides of the opening 11. The openings 24 are therefore situated in one plane with the ring-shaped bottom area of the plate 13, while the molded-in areas 23 project downward to an extent which corresponds to the distance between two adjacent disk bodies 10.

However, the plate 13 also has a molded-in area 30 which extends radially toward the outside from the molded-out area 23 of the left opening (FIG. 11), this molded-in area 30, as indicated in FIG. 1, forming a partition between the feeding piece 3 and the discharge piece 4 for the cooling liquid which is forced in this manner to flow in the space between two disk bodies 10 along the path marked by the arrows 9 in FIG. 1.

Figure 6:
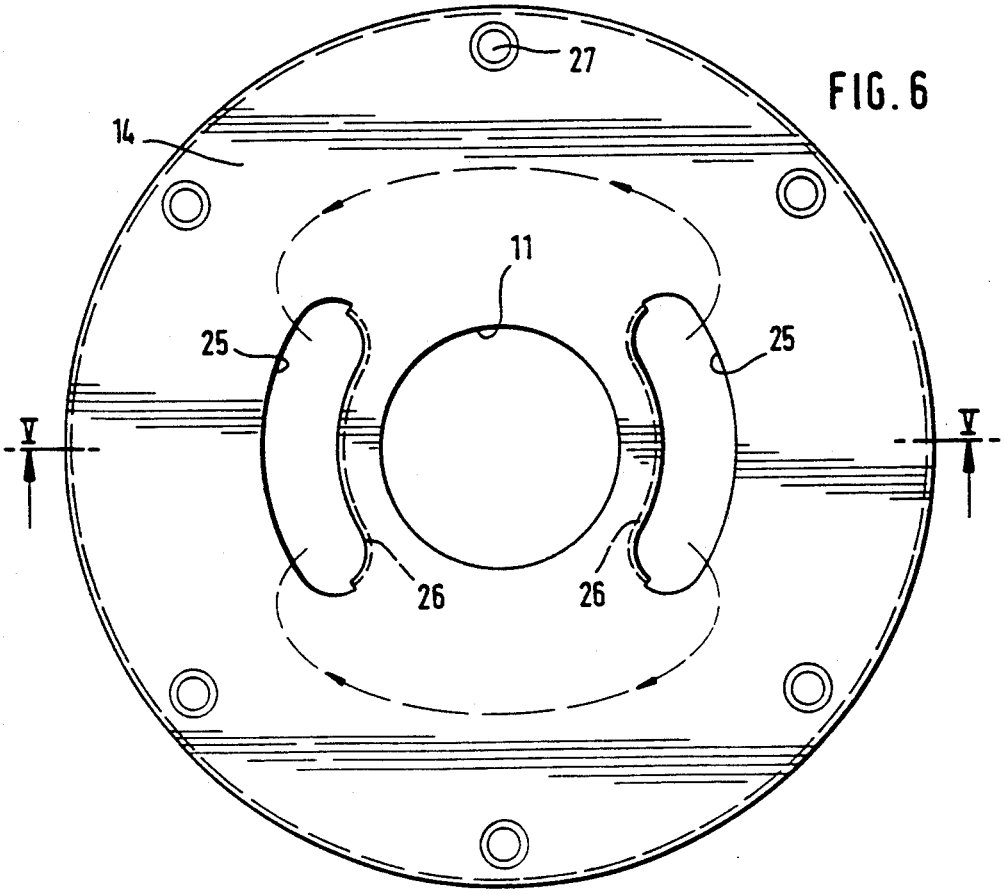
FIG. 6 is a top view of the lid plate of FIG. 5.

The plate 14 forming the lid of the disk body I0 has a different construction in the area of the inside opening 11. It has no edge framing the opening 11 but, in the area of two kidney-shaped openings 25 which are also opposite the opening 11, is only provided with one web 26 respectively provided at the interior edge of the respective opening 25, the web 26 limiting the opening 25 toward the inside and extending to closely in front of the edge of the opening 24 of the other plate. In this manner, the webs are used for the guiding of the oil flow and have the effect that the oil must flow through the disks in the direction of the arrows indicated by an interrupted line in FIG. 6 and does not flow from one opening 25 on the inside to the opposite opening. The plates 13, 14 are secured in the outer area in their position to one another by means of the areas 20, 21 of the edges 16, 18 which snap into one another. FIGS. 5, 6 and 8 show that each of the approximately circular plates 14 is provided with outwardly directed button-type molded-out areas 27 which are distributed uniformly on the circumference and have the purpose of causing the support with respect to adjacent disk bodies. The molded-out areas 27 of plate 14, in this case, support themselves on corresponding molded-out areas 28 of the plate 13 (see FIGS. 10, 11 and 13), the height of which also corresponds to half the distance between adjacent disk bodies. Therefore, while the molded-out areas 23 take over the support with respect to adjacent disk bodies in the interior area of the disk bodies, this is caused by the molded-out areas 27, 28 in the exterior area of the disk bodies.

It is easily recognizable in FIG. 4 that it is not difficult to manufacture individual disk bodies first by the joining of plates 13, 14 which each, before the lid and the bottom part are fitted together, may also be provided with corresponding turbulence inserts. The thus formed relatively stable disk bodies may then be threaded onto the tube 12 and be arranged inside the cup-shaped housing 1 which at first is still open. This may take place while soldering foils are inserted at the same time which may also be placed between both plates 13, 14 before these plates are pressed together. Instead of the additional inserting of soldering foils, it is better to provide the plates 13, 14 directly with a solder plating. After this has happened, the bottom 2 is mounted which provides that all disk bodies are pressed against one another by means of the required axial force. The thus pre-assembled disk oil coolers are then soldered together in a soldering furnace. As a result of the selected design, a good and tight connection of all parts is achieved.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. An oil cooler for an internal combustion engine, comprising:

housing means through which a cooling medium flows, and a plurality of disk bodies stacked adjacent one another in said housing means, each of said disk bodies including a top disk plate and a bottom disk plate, said top and bottom disk plates being fit together to define a hollow space therebetween for accommodating flow of oil to be cooled, said disk bodies including flow-through openings for accommodating flow of oil to be cooled between respective hollow spaces of adjacent disk bodies, wherein the peripheral edges of the respective top and bottom disk plates of a disk body are configured as respective annular wall sections which lockingly inter-engage with one another to lockingly hold the disk plates together at a predefined distance, wherein the annular wall sections of the disk plates are each provided with chamfering which mutually engages with chamfering of the other of the disk plate annular wall sections to facilitate pushing the peripheral edges of disk plates together, said annular wall section of the top disk plate having an internally surrounding indentation over its entire circumference and the annular wall section of the bottom disk plate having an externally surrounding edge over its entire circumference which lockingly fits the internally surrounding indentation of the annular wall section of the top plate.

2. An oil cooler according to claim 1, wherein the respective annular wall sections are soldered together.

3. An oil cooler according to claim 2, wherein the disk plates have a circular shape.

4. An oil cooler according to claim 1, wherein the internally surrounding indentation of the annular wall section of the top disk plate corresponds to the vertex of an indentation opening at an obtuse angle toward the interior, wherein the exterior surrounding edge of the annular wall section of the bottom plate corresponds to the vertex of a cross-section which also opens at an obtuse angle toward the interior, and wherein the size of the two obtuse angles is approximately the same.

5. An oil cooler according to claim 2, wherein each of the top and bottom disk plates is provided with outwardly directed molded-out areas which are arranged on the circumference in a uniformly distributed manner for establishing the spacing of adjacent disk bodies.

6. An oil cooler according to claim 2, wherein the bottom disk plate is provided with an inwardly directed passage which can be pushed onto a central oil cooler tube.

7. An oil cooler according to claim 4, wherein the top disk plate has a central opening corresponding to the inwardly directed passage of the bottom disk plate, said opening being adapted to be pushed onto a central oil cooler tube.

8. An oil cooler according to claim 7, wherein both top and bottom disk plates of a disk body have openings for the oil flow which are opposite the central opening, and wherein devices situated in the area of these openings which are used for guiding the oil flow are assigned to at least one of the disk plates.

9. An oil cooler according to claim 6, wherein the opposite openings of the bottom disk plate are framed in each case by outwardly directed molded-out areas having a height corresponding to a predetermined spacing between two adjacent disk bodies.

10. An oil cooler according to claim 6, wherein the devices provided for the guiding of the oil flow between the disk plates and in the area of the central opening comprise two webs which each bound the opposite openings of one plate toward the interior and extend to closely in front of the edge of the opening of the other plate.

11. An oil cooler according to claim 2, wherein a radially extending molded-in area is assigned to at least one of the disk plate and serves as a partition between feeding and discharge openings for the cooling medium.

12. An oil cooler according to claim 1, wherein the cooling medium is cooling liquid.

13. A disk body for an oil cooler of the type having a plurality of disk bodies stacked adjacent one another, said disk body including a top disk plate and a bottom disk plate, said top and bottom disk plates being fit together to define a hollow space therebetween for accommodating flow of oil to be cooled, said disk bodies including flow-through openings for accommodating flow of oil to be cooled between respective hollow spaces of adjacent disk bodies, wherein the peripheral edges of the respective top and bottom disk plates of a disk body are configured as respective annular wall sections which lockingly inter-engage with one another to lockingly hold the disk plates together at a predefined distance, wherein the annular wall sections of the disk plates are each provided with chamfering which mutually engages with chamfering of the other of the disk plate annular wall sections to facilitate pushing the peripheral edges of disk plates together, said annular wall section of the top disk plate having an internally surrounding indentation over its entire circumference and the annular wall section of the bottom disk plate having an externally surrounding edge over its entire circumference which lockingly fits the internally surrounding indentation of the annular wall section of the top plate.

14. A disk body according to claim 11, wherein the respective annular wall sections are soldered together.

15. A disk body according to claim 12, wherein each of the top and bottom disk plates is provided with outwardly directed molded-out areas which are arranged on the circumference in a uniformly distributed manner for establishing the spacing of adjacent disk bodies.

* * * * *